US006312292B2

(12) United States Patent
Liu

(10) Patent No.: US 6,312,292 B2
(45) Date of Patent: Nov. 6, 2001

(54) LOW CROSSTALK CONNECTOR

(75) Inventor: Danny Liu, Taipei (TW)

(73) Assignee: Dan-Chief Enterprise Co., Taipei (TW)

( * ) Notice: Subject to any disclaimer, the term of this patent is extended or adjusted under 35 U.S.C. 154(b) by 0 days.

(21) Appl. No.: 09/767,677

(22) Filed: Jan. 23, 2001

Related U.S. Application Data

(63) Continuation-in-part of application No. 09/481,890, filed on Jan. 12, 2000.

(30) Foreign Application Priority Data

Jun. 9, 1999 (TW) ..... 88209458
Oct. 11, 2000 (TW) ..... 088209457A01

(51) Int. Cl.[7] ..... H01R 24/00
(52) U.S. Cl. ..... 439/676
(58) Field of Search ..... 439/676, 941, 439/918, 83, 942

(56) References Cited

U.S. PATENT DOCUMENTS 3,951,494 * 4/1976 Romine ..... 439/942
5,772,454 * 6/1998 Long, Jr. ..... 439/83
6,042,427 3/2000 Adriaenssens et al. .
6,206,734 * 3/2001 Liu ..... 439/676

* cited by examiner

*Primary Examiner*—Brian Sircus
*Assistant Examiner*—Phuong K T Dinh
(74) *Attorney, Agent, or Firm*—Volpe and Koenig, P.C.

(57) ABSTRACT

An electrical connector for the specifications beyond CAT5e includes a plurality of metal contact assemblies and a connector entity. The connector entity includes a plurality of slits for inserting therein the metal contact assemblies, and includes a plurality of openings in order that the each of the metal contact assemblies makes an electric contact outside the connector entity. Each of the metal contact assembly includes a first metal contact and a second metal contact. Each of the first metal contact has a first contact part and each of the second metal contact has a third contact part. Both of the first and third contact parts are used for making an electric contact outside the connector entity. Further, each of the first metal contact has a second contact part and each of the second metal contact has a fourth contact part, and both of the second and fourth contact parts are used for making an electrical connection outside the connector entity. The first metal contact and the second metal contact are inserted into the slits in turn and in parallel so as to form a desired capacitance for reducing the crosstalk interference.

24 Claims, 7 Drawing Sheets

LOW CROSSTALK CONNECTOR

This application is a continuation-in-part application of the pending application Ser. No. 09/481,890, filed on Jan. 2, 2000.

FIELD OF THE INVENTION

The present invention relates to an electrical connector, and more particularly to a low crosstalk electrical connector, which applies to reduce the crosstalk interference taken place in the signal transmission process.

DESCRIPTION OF THE PRIOR ART

Typically, in a microelectronic circuit, an electrical connector is applied to connect the host machine with a plurality of peripheral devices for transmitting electric signals. Among the miscellaneous electrical connectors, a network connector, however, is particularly applied in the field involved with the network communication. The network connector roughly falls into a network socket and a network cable plug, wherein the latter is directly related to the quality of the signal transmission. Please refer to FIG. 1 and FIG. 2 showing a network cable plug adapted to be plugged into the network socket 10. The network cable plug comprises a housing, an auxiliary piece 12, and a plurality of copper contacts 13. Each of the copper contacts 13 includes a contact part 131 and a connection part 132. The contact part 131 is used to contact with the pins embedded in the socket 10 and the connection part 132 is used to couple with a cable tightly. The auxiliary piece 12 is used for assisting the housing 11 to be plugged in and drawn out the network socket 10. Preferably, the housing 11 is made up of a transparent plastic. FIG. 2 shows the amplified diagram of the copper contact 13, wherein the copper contact 13 includes a contact part 131 and a connection part 132 as previously discussed.

Nonetheless, there are several disadvantages existed in the prior art network cable plug. When manufacturing the network cable plug, the copper contacts must be inserted into the slits one by one. If the copper contacts are inserted manually, it is obviously inefficient and time-consuming. However, if an automatic equipment are used to take place of manpower for inserting the copper contacts, the profit will be reduced thereby. In addition, the conventional network cable plug can only match the TIA568A CAT-5 specification. It can not match tile specification for ligh-speed signal transmission beyond the CAT5e specification due to the restriction of its structure. As a result, the crosstalk interference will take place in the signal transmission process.

For the purpose of reducing the crosstalk interference generated during the signal transmissions process, the shape, size, thickness and dimensions of the metal contact blades are manipulated to restore capacitance. Hence, there is a tendency for the applicant to develop an electrical connector which can match the specifications beyond CAT5e and reduce the crosstalk interference among signal transmissions.

SUMMARY OF THE INVENTION

It is therefore an object of the present invention to provide an electrical connector which can be manufactured with a simpler process and with a lower cost.

Another object of the present invention is to provide an electrical connector which can match the specification for the high-speed signal transmission beyond CAT5e specification.

Another further object of the present invention is to provide a metal contact assembly used within an electrical connector.

Another yet object of the present invention is to provide an electrical connector which can reduce the crosstalk interference Generated during the signal transmission process.

According to the first embodiment of the present invention, the electrical connector includes a plurality of metal contact assemblies and a connector entity. The connector entity includes a plurality of slits for inserting therein the plurality of metal contact assemblies, and includes a plurality of openings in order that each of the metal contact assemblies makes an electric contact outside the connector entity thereof.

Certainly, the connector entity is made of plastic, and each of the metal contact assemblies includes a first metal contact and a corresponding second metal contact, wherein each of the metal contact assemblies are inserted into the slits in turn and in parallel so that the mutual arrangement of the first metal contacts and the second metal contacts is interlaced.

In accordance with the present invention, each of the first metal contacts further includes a first contact part protruding from a corresponding opening of the connector entity for making an electric contact outside the connector entity, and a second contact part f or making an electrical connection outside the connector entity.

Similarly, each of the second metal contacts further includes a third contact part protruding from a corresponding opening of the connector entity for making an electric contact outside the connector entity, and a fourth contact part for making an electrical connection outside the connector entity.

Furthermore, each of the first metal contacts further includes a plurality of teeth extending upwardly from the bottom edge of the first metal contact and each of the second metal contacts further includes a corresponding plurality of teeth extending downwardly from the top edge of the second metal contact so as to from a desired capacitance.

The structure of second contact part and the fourth contact part of the metal contact may be of a variety of types depending on the design specification. As an example, generally both of the second contact part and the fourth contact part are a pin for welding on a printed circuit board (PCB). Alternatively, both of the second contact part and the fourth contact part are a two-prong pin for displacing the wire insulation in order to electrically connect with the cable. In accordance with the third embodiments of the present invention, both of the second contact part and the fourth contact part are a three-prong pin for piercing a cable and electrically connecting with the cable. According to the fourth embodiment of the present invention, both of the second contact part and the fourth contact part are a semicircle for fixing a cord by means of squeezing to electrically connect with the cable.

Preferably, the metal contact assemblies are made of copper.

In accordance with another aspect of the present invention, a metal contact assembly applicable to be used within an electrical connector such that the crosstalk interference taken place in the signal transmission process is reduce is provided, wherein the electrical connector includes a connector entity including a plurality of slits. The metal contact assembly includes a first metal contact inserted in one of the slits of the connector entity and having a first contact part protruding from an opening of the connector entity for making electric contact outside the connector entity and a second contact part for making an electrical connection outside the connector entity, and a second metal contact inserted in one of the slits neighboring to that of the first metal contact in parallel and having a third contact part protruding from an opening of the connector entity for making electric contact outside the connector entity, and a fourth contact part for making an electrical connection outside the connector entity. Remarkably, the metal contact assembly is characterized in that each of the first metal contacts include a plurality of teeth extending upwardly from the bottom edge of the first metal contacts and each of the second metal contacts includes a corresponding plurality of teeth extending downwardly from the top edge of the second metal contacts so as to from a desired capacitance for reducing the crosstalk interference generated during the signal transmission process. Now the present invention will be more clearly understood through the following descriptions with reference to the accompanying drawings, in which:

DETAILED DESCRIPTION OF THE PREFERRED EMBODIMENTS

Figure 1:
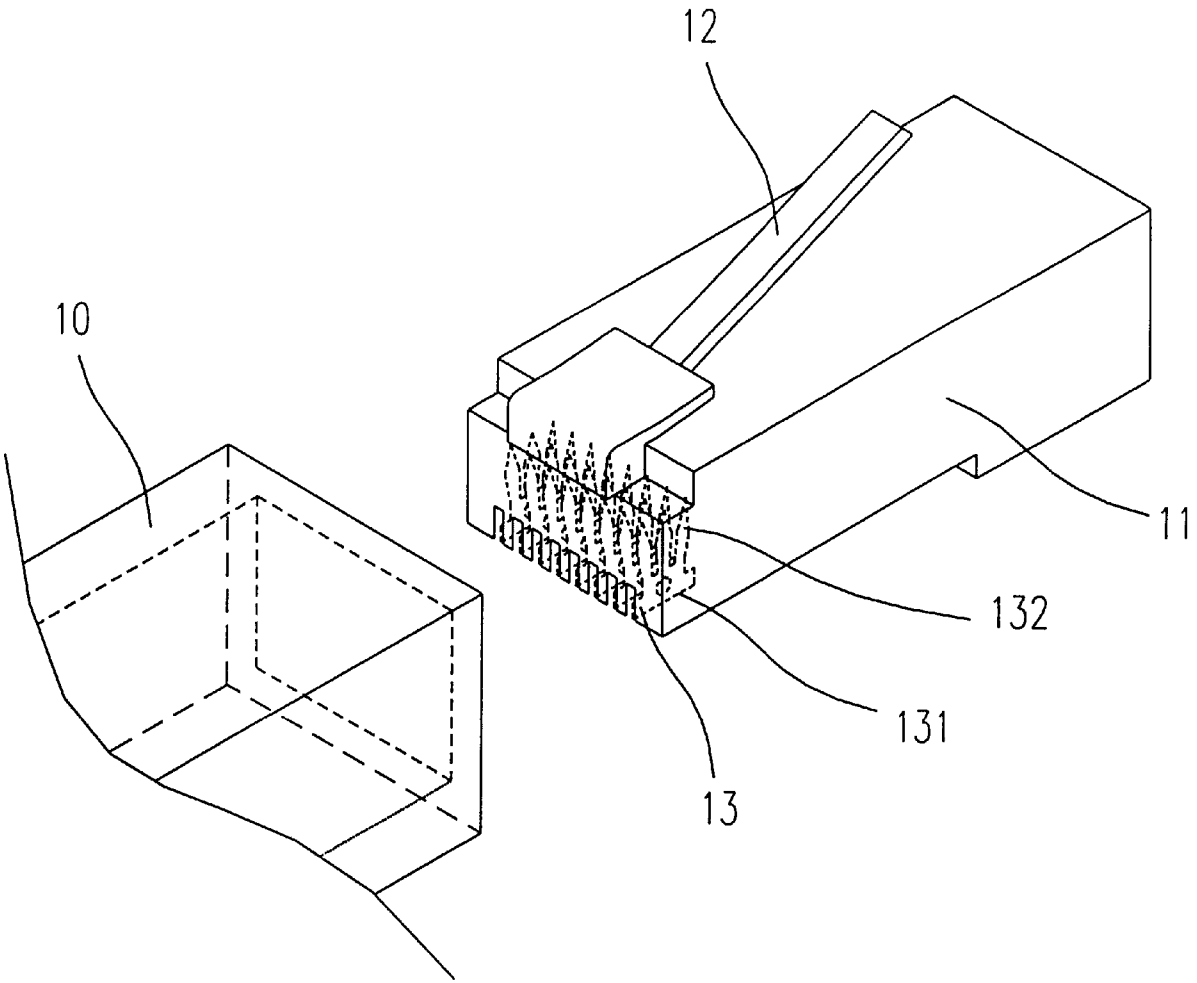
Fig. 1(PRIOR ART)
FIG. 1 is a schematic diagram showing the conventional electrical connector.
Figure 2:
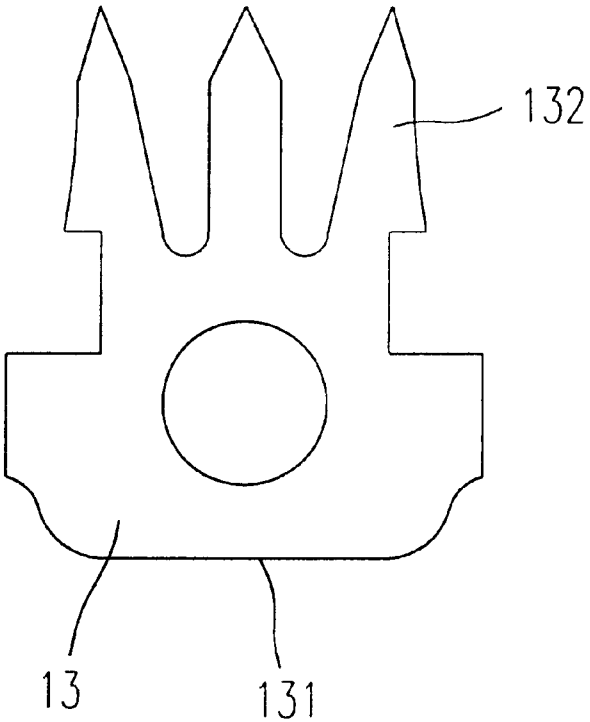
Fig. 2(PRIOR ART)
FIG. 2 is an amplified diagram showing the metal contact used within the conventional electrical connector.
Figure 3:
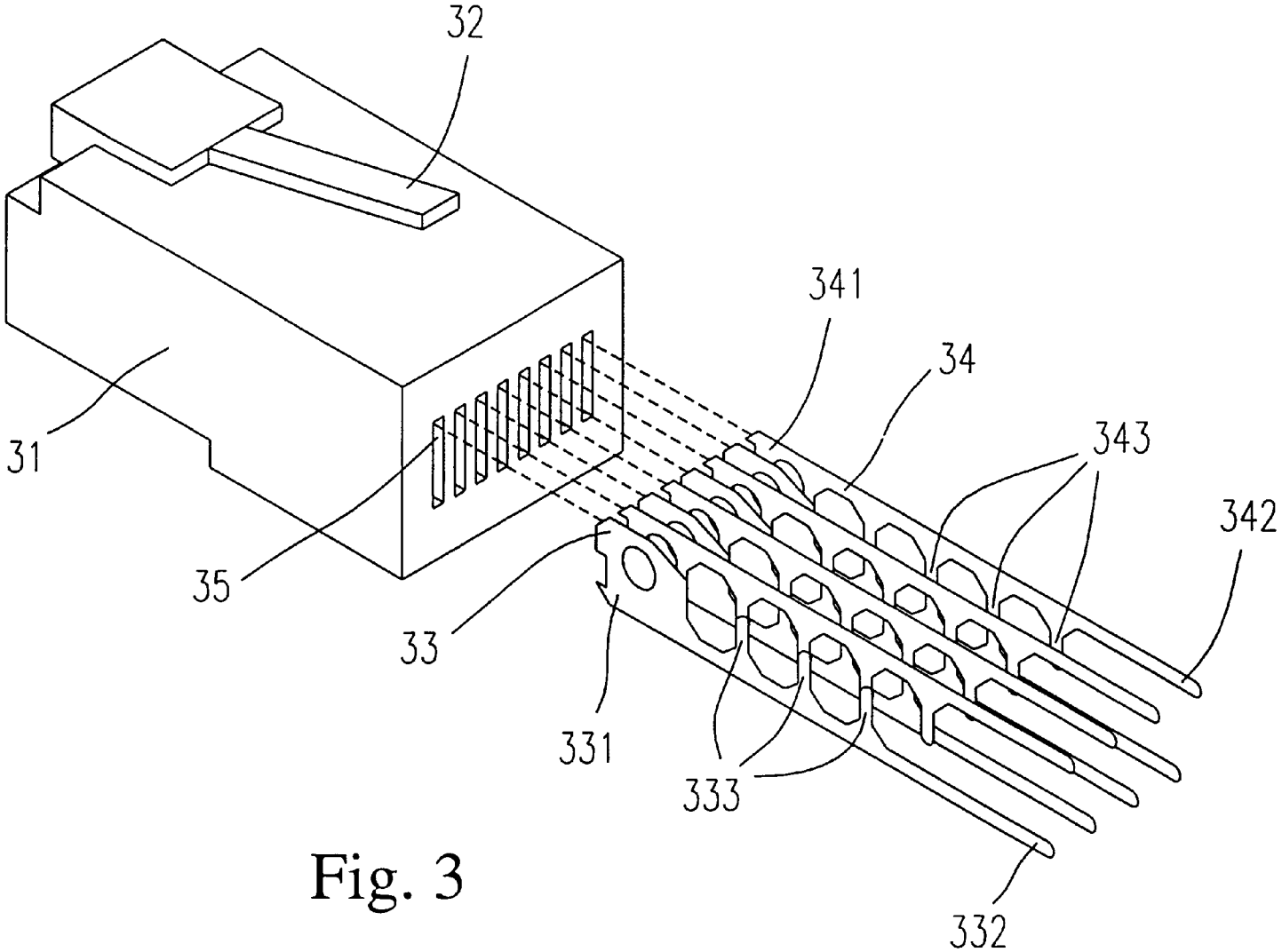
FIG. 3 is an exploded view showing the electrical connector structure according to the present invention.
Figure 4:
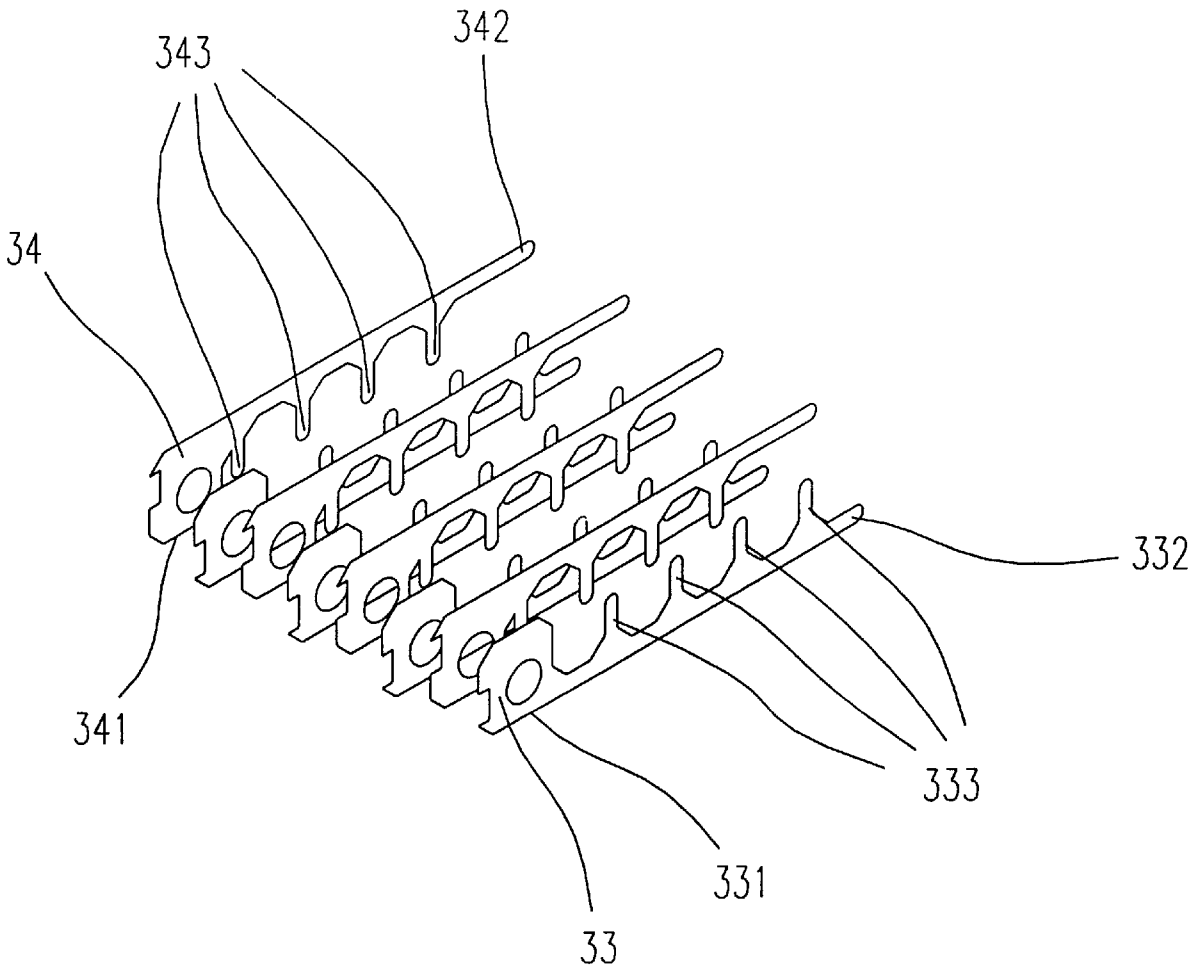
FIG. 4 is a schematic diagram showing the first embodiment ot the metal contact assembly used within an electrical connector according to the present invention.

Please refer to FIG. 3 and FIG. 4 showing the electrical connector and the metal contact assembly of the present invention. The electrical connector includes a connector entity 31 which is provided with a plurality of slits 35 for the metal contact assemblies (33, 34) to be inserted therein. The connector entity 31 which is made of an insulating material such as plastic further includes an auxiliary piece 32 for assisting the connector entity 31 to be plugged into a socket (which is not shown in the drawings).

There are eight slits 35 embedded in the connector entity 31 provided for inserting therein a plurality of metal contact assemblies (33, 34). Each of the metal contact assemblies (33, 34) includes a first metal contact 33 and a second metal contact 34, and both of the metal contacts are made of copper. The first metal contact 33 has a plurality of teeth 333 extending upwardly from the bottom edge of the first metal contact 33 and the second metal contact 34 also has a corresponding plurality of teeth 343 extending downwardly from the top edge of the second metal contact 34. Therefore, the shape of the first metal contact 33 and that of the second metal contacts 34 are complement so that the mutual arrangement of the first metal contacts 33 and the second metal contacts 34 forms a desired capacitance. The first metal contacts 33 and the second metal contacts 34 are inserted into the slits 36 in turn and in parallel.

Certainly, the number and the size of the teeth are not confined to the foregoing embodiment, but depends on the designed specification. Besides, their mutual arrangement is flexible, for instance, two first metal contacts 33 and two second metal contacts 34 can be spacedly interposed in parallel, or four first metal contacts 33 and four second metal contacts 34 can be spacedly interposed in parallel.

The first metal contact 33 further include a first contact part 331 and a second contact part 332, and the second metal contact 34 further include a third contact part 341 and a fourth contact part 342. The first contact part 331 and the third contact part 341 are protruded from the opening of the connector entity 31 (which is not shown) and therefore exposed outside the connector entity 31 to contact with the pins embedded in a socket when the connector entity 31 is plugged into the socket. The second contact part 332 and the fourth contact part 342 can be welded into a printed circuit board (which is not shown in the drawings) for transmitting electric signal.

Figure 5:
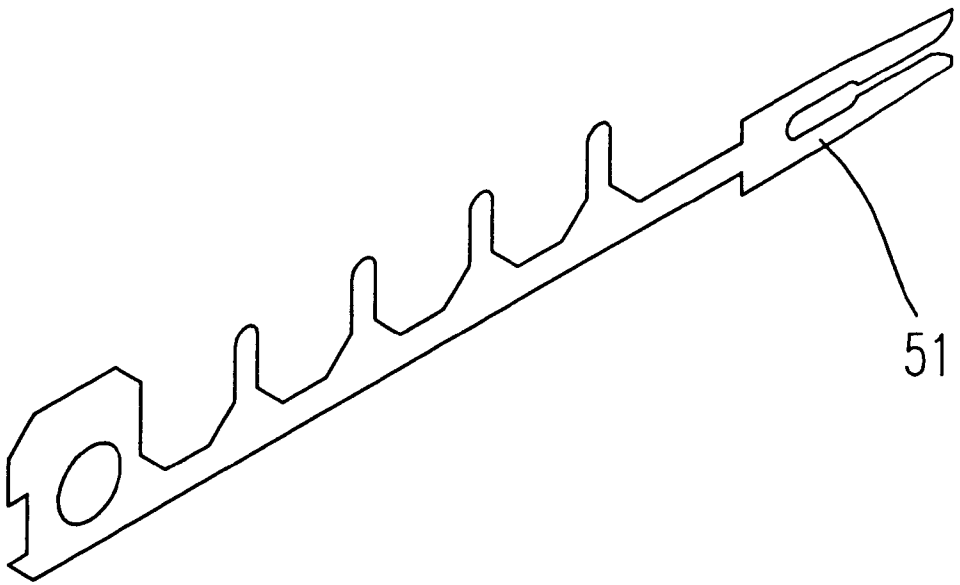
FIG. 5 is a schematic diagram showing the second embodiment of the metal contact assembly used within an electrical connector according to the present invention.
Figure 6:
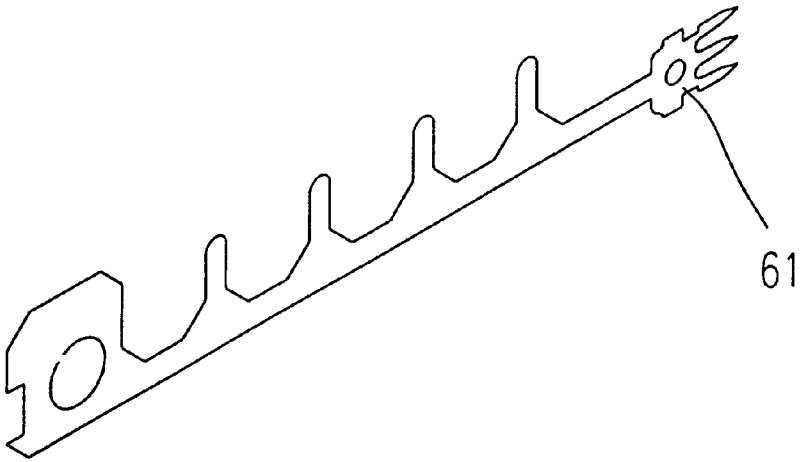
FIG. 6 is a schematic diagram showing the third embodiment of the metal contact used within an electrical connector according to the present invention.
Figure 7:
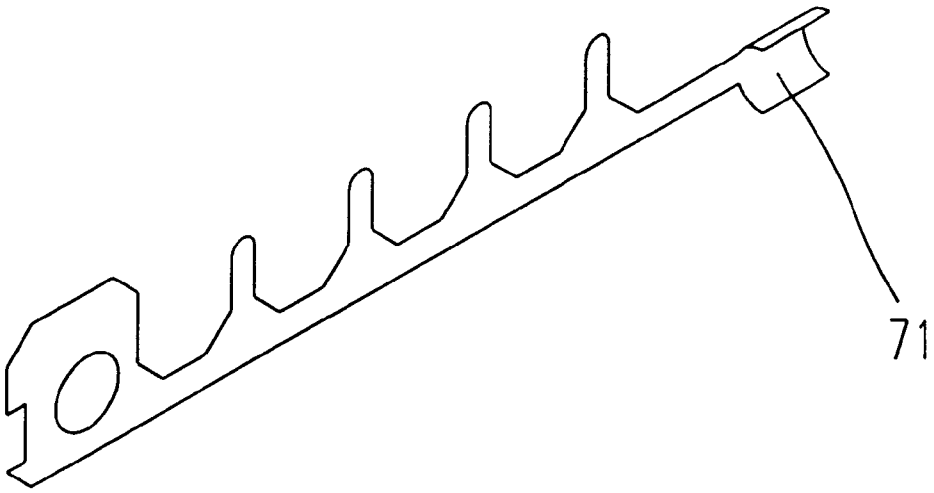
FIG. 7 is a schematic diagram showing the fourth embodiment of the metal contact used within an electrical connector according to the present invention.

Please refer to FIG. 5, FIG. 6, and FIG. 7. The metal contact assembly can have many types. The contact part 51 of the metal contact assembly shown in FIG. 5 is a two-prong pin for displacing the wire insulation and electrically connect with the cable. The contact part 61 of the metal contact assembly shown in FIG. 6 is a three-prong pin for piercing a cable and electrically connect with the cable, and the contact part 71 of the metal contact assembly shown in FIG. 7 is a semicircle for fixing a cord by means of squeezing.

One characteristic of the electrical connector structure of the present invention is that the electrical connector is constituted by the connector entity including a plurality of slits and the metal contact assemblies. It is indicative that the slit base having a plurality of slits for the metal contact assemblies to be inserted therein and the housing of the electrical connector are integrally manufactured. Thus, when manufacturing the electrical connector, the operator does not need to insert the metal contact assemblies into a slit base first and then placing the slit base in the slot of the housing tightly. In the manufacturing, process of the electrical connector, the operator only needs to insert the metal contacts into the slits of the connector entity and the manufacturing process for the electrical connector is accomplished.

Another characteristic of the electrical connector structure of the present invention is that the shape of first metal contact and that of the second metal contact are complement, and both of them arc arranged to form the desired capacitance. Therefore, the crosstalk interference generated during the signal transmission process will be reduced and the electrical connector formed thereby can match the specifications beyond CAT5e for high-speed signal transmission.

It is intended to emphasize that the shape used to form the desired capacitance is not limited to the form of teeth as shown in the diagrams. Adversely, it can be of any form that can form the desired capacitance for reducing the crosstalk interference.

Comparing the electrical connector structure of the present invention with that of the prior art, the former is more practical and effortless to be manufactured, and can be employed in the application of high-speed signal transmission.

While the invention has been described in terms of what are presently considered to be the most practical and preferred embodiments, it is to be understood that the invention need not be limited to the disclosed embodiment. On the contrary, it is intended to cover various modifications and similar arrangements included within the spirit and scope of the appended claims which arc to be accorded with the broadest interpretation so as to encompass all such modifications and similar structures. Therefore, the above description and illustration should not taken as limiting the scope of the present invention which is defined by the appended claims.

What is claimed is:

1. An electrical connector, comprising:

a plurality of metal contact assemblies provided for forming a desired capacitance, each of said metal contact assemblies including a first metal contact and a corresponding second metal contact, each of said first metal contacts further including a plurality of teeth extending upwardly from a bottom edge of said first metal contacts and each of said second metal contacts including a corresponding plurality of teeth extending downwardly from a top edge of said second metal contacts; and a connector entity including a plurality of slits for allowing said metal contact assemblies to be inserted therein, and including a plurality of openings in order that each of said metal contact assemblies makes an electric contact outside said connector entity.

2. An electrical connector according to claim 1, wherein said connector entity is formed with an insulating material.

3. An electrical connector according to claim 2, wherein said insulating material comprises a plastic.

4. An electrical connector according to claim 1, wherein each of said first metal contacts and each of said second metal contacts are inserted in said slits in turn and in parallel so that the mutual arrangement of said first metal contacts and said second metal contacts is interlaced.

5. An electrical connector according to claim 4, wherein each of said first metal contacts includes:

a first contact part protruding from one of said openings of said connector entity for making an electric contact outside said connector entity; and a second contact part for welding on a printed circuit board (PCB).

6. An electrical connector according to claim 5, wherein each of said second metal contacts includes:

a third contact part protruding from one of said openings of said connector entity for making an electric contact outside said connector entity; and a fourth contact part for welding on a printed circuit board (PCB).

7. An electrical connector according to claim 6, wherein both of said second contact part and said fourth contact part comprise a pin.

8. An electrical connector according to claim 4, wherein each of said first metal contacts includes:

a first contact part protruding from one of said openings of said connector entity for making an electric contact outside said connector entity; and a second contact part for displacing the wire insulation to electrically connect with a cable.

9. An electrical connector according to claim 8, wherein each of said second metal contacts includes:

a third contact part protruding from one of said openings of said connector entity for making an electric contact outside said connector entity; and a fourth contact part for displacing the wire insulation to electrically connect with a cable.

10. An electrical connector according to claim 9, wherein both of said second contact part and said fourth contact part comprise a two-prong pin.

11. An electrical connector according to claim 4, wherein each of said first metal contacts includes:

a first contact part protruding from one of said openings of said connector entity for making an electric contact outside said connector entity; and a second contact part for piercing a cable and electrically connected with said cable.

12. An electrical connector according to claim 11, wherein each of said second metal contacts includes:

a third contact part protruding from one of said openings of said connector entity for making an electric contact outside said connector entity; and a fourth contact part for piercing a cable and electrically connected with said cable.

13. An electrical connector according to claim 12, wherein both of said second contact part and said fourth contact part comprise a three-prong pin.

14. An electrical connector according to claim 4, wherein each of said first metal contacts includes:

a first contact part protruding from one of said openings of said connector entity for making an electric contact outside said connector entity; and a second contact part for fixing a cord by means of squeezing.

15. An electrical connector according to claim 14, wherein each of said second metal contacts includes:

a third contact part protruding from one of said openings of said connector entity for making an electric contact outside said connector entity; and a fourth contact part for fixing a cord by means of squeezing.

16. An electrical connector according to claim 15, wherein both of said second contact part and said fourth contact part comprises a semicircle.

17. An electrical connector according to claim 1, wherein said metal contact assemblies are formed with copper.

18. An electrical connector, comprising:

a connector entity including a plurality of slits, in which a plurality of metal contact assemblies, each of which includes a first metal contact and a second metal contact, are inserted therein;

wherein said connector entity including a plurality of opening in order that each of said metal contact assemblies makes an electric contact outside said connector entity thereof, and each of said first metal contacts and said second metal contacts are inserted in said slits in turn and in parallel in order that the mutual arrangement of said first metal contacts and said second metal contacts is interlaced, and each of said first metal contacts includes a plurality of teeth extending upwardly from a bottom edge of said first metal contacts and each of said second metal contacts includes a corresponding plurality of teeth extending downwardly from a top edge of said second metal contacts so as to form a desired capacitance.

19. An electrical connector according to claim 18, wherein:

said first metal contact includes a first contact part protruding from one of said openings of said connector entity for making an electric contact outside said connector entity, and a second contact part for making an electric connection outside said connector entity; and said second metal contact includes a third contact part protruding from one of said openings of said connector entity for making an electric contact outside said connector entity, and a fourth contact part for making an electric connection outside said connector entity.

20. An electrical connector according to claim 19, wherein both of said second contact part and said fourth contact part comprise a pin for welding on a printed circuit board (PCB).

21. An electrical connector according to claim 19, wherein both of said second contact part and said fourth contact part comprise a two-prong pin for displacing the wire insulation to electrically connect with the cable.

22. An electrical connector according to claim 19, wherein both of said second contact part and said fourth contact part comprise a three-prong pin for piercing a cable and electrically connected with said cable.

23. An electrical connector according to claim 19, wherein both of said second contact part and said fourth contact part comprise a semicircle for fixing a cord by means of squeezing.

24. A metal contact assembly applicable to be used within an electrical connector for reducing the crosstalk interference, wherein said electrical connector comprises a connector entity including a plurality of slits, comprising:

a first metal contact inserted in one of said slits of said connector entity and having a first contact part protruding from an opening of said connector entity for making electric contact outside said connector entity, and a second contact part for making an electrical connection outside said connector entity; and a second metal contact inserted in one of said slits neighboring to that of said first metal contact in parallel and having a third contact part protruding from an opening of said connector entity for making electric contact outside said connector entity, and a fourth contact part for making an electrical connection outside said connector entity;

and characterized in that each of said first metal contacts include a plurality of teeth extending upwardly from a bottom edge of said first metal contacts and each of said second metal contacts includes a corresponding plurality of teeth extending downwardly from a top edge of said second metal contacts so as to from a desired capacitance for reducing said crosstalk interference.

* * * * *